US006766860B2

(12) United States Patent
Archibald et al.

(10) Patent No.: US 6,766,860 B2
(45) Date of Patent: Jul. 27, 2004

(54) MULTI-ACTIVITY OFFSHORE DRILLING FACILITY HAVING A SUPPORT FOR TUBULAR STRING

(75) Inventors: William G. Archibald, Highland Village, TX (US); Paul Bruton, Singapore (SG)

(73) Assignee: GlobalSantaFe Corporation, Dallas, TX (US)

( * ) Notice: Subject to any disclaimer, the term of this patent is extended or adjusted under 35 U.S.C. 154(b) by 39 days.

(21) Appl. No.: 10/080,494

(22) Filed: Feb. 22, 2002

(65) Prior Publication Data

US 2003/0159853 A1 Aug. 28, 2003

(51) Int. Cl.[7] ..... E21B 29/12

(52) U.S. Cl. ..... 166/341; 166/343; 175/85; 414/22.68

(58) Field of Search ..... 166/341, 343; 175/5, 85; 414/22.57, 22.63, 22.68

(56) References Cited

U.S. PATENT DOCUMENTS

| | | | | | |
|---|---|---|---|---|---|
| 3,638,338 | A | | 2/1972 | Nelson | |
| 3,693,729 | A | * | 9/1972 | Blurton et al. | 173/189 |
| 3,895,677 | A | * | 7/1975 | Bokenkamp | 166/359 |
| 3,987,910 | A | * | 10/1976 | Brunato | 414/22.63 |
| 4,090,368 | A | * | 5/1978 | Bell et al. | 405/201 |
| 4,097,069 | A | | 6/1978 | Morrill | |
| 4,108,318 | A | | 8/1978 | Rode et al. | |
| 4,117,941 | A | * | 10/1978 | McCleskey et al. | 414/22.63 |
| 4,208,158 | A | | 6/1980 | Davies et al. | |
| 4,227,831 | A | | 10/1980 | Evans | |
| 4,315,709 | A | * | 2/1982 | Gulick | 414/22.57 |
| 4,330,140 | A | | 5/1982 | Hampton | |
| 4,367,796 | A | * | 1/1983 | Bolding | 166/341 |
| 4,446,807 | A | | 5/1984 | Johnson et al. | |
| 4,465,422 | A | * | 8/1984 | Blust et al. | 414/433 |
| 4,586,572 | A | * | 5/1986 | Myers et al. | 175/85 |
| 4,626,135 | A | | 12/1986 | Roche | |
| 4,716,972 | A | | 1/1988 | Makinen et al. | |
| 4,725,179 | A | * | 2/1988 | Woolslayer et al. | 414/22.65 |
| 4,819,730 | A | | 4/1989 | Williford et al. | |
| 4,850,439 | A | * | 7/1989 | Lund | 175/52 |
| 4,899,682 | A | * | 2/1990 | Pouget et al. | 114/264 |
| 5,647,443 | A | | 7/1997 | Broeder | |
| 5,819,852 | A | | 10/1998 | Cunningham et al. | |
| 5,865,260 | A | | 2/1999 | Jackson et al. | |
| 6,047,781 | A | | 4/2000 | Scott et al. | |
| 6,056,071 | A | | 5/2000 | Scott et al. | |
| 6,068,069 | A | | 5/2000 | Scott et al. | |
| 6,085,851 | A | | 7/2000 | Scott et al. | |
| 6,213,215 | B1 | | 4/2001 | Breivik et al. | |
| 6,217,258 | B1 | | 4/2001 | Yamamoto et al. | |

* cited by examiner

*Primary Examiner*—Robert E. Pezzuto
*Assistant Examiner*—Thomas A Beach
(74) *Attorney, Agent, or Firm*—David W. Carstens; Carstens Yee & Cahoon, LLP

(57) ABSTRACT

An offshore drilling rig contains a heavy-duty support cart that straddles the moonpool and rides on rails. A funnel-shaped hole extends through the support cart, and a cutout on one side of the cart provides lateral access to the hole. The cart can be moved to the region of the rotary assembly, where a length of tubulars can be suspended from the cart. For instance, when the BOP is pulled out for installation of the Xmas tree assembly, the BOP and attached riser can be pulled up above the seabed and hung from the support cart, then moved laterally out of the way while the Xmas tree assembly is installed. This lateral movement lowers the possibility of collision between the BOP and Xmas tree assembly. The BOP assembly can then be disassembled and at a later time, or hung until is needed for an adjacent borehole. In a preferred embodiment, the cart is included on multi-activity rigs with more than one load path, hoist, and rotary assembly.

15 Claims, 5 Drawing Sheets

MULTI-ACTIVITY OFFSHORE DRILLING FACILITY HAVING A SUPPORT FOR TUBULAR STRING

TECHNICAL FIELD OF THE INVENTION

The present invention relates to a method and device for decreasing the working time necessary for floating offshore drilling for petroleum products and for increasing the safety of the work. The invention further relates to a support cart, from which can be hung a long string of tubulars, and a method of using the support cart to allow installation of the set of production valves known as a Xmas tree without the need to completely pull the blow-out preventor (BOP) out of the water.

BACKGROUND TO THE INVENTION

Locating oil in deep water requires the use of large and expensive drilling rigs. These rigs can be drill ships, barges, tension leg platforms (TLPs), spars, or semi-submersibles. In each case, the investment is substantial. However, the need to find additional reservoirs of oil and natural gas is creating a need for a deep-water rig that can efficiently explore, drill and develop wells in ever deeper water, with current technology moving to achieve production at 7500 feet or greater.

The cost of developing a well is more than simply the cost of the rig. Every day of rig operation can cost in the hundreds of thousands of dollars. Therefore, it is important that operations run as smoothly, quickly, and safely as possible. One direction of development in offshore drilling is in multi-tasking jobs, that is, rather than performing the drilling and casing as one long set of sequential steps, some steps are effectively moved "offline", where they can be handled in parallel with other steps. For example, U.S. Pat. No. 6,056,071, which is hereby incorporated by reference, discloses an offshore drillship in which the single derrick has two top-drives (main and auxiliary) and two sets of equipment to handle tubulars (drill pipe, casing, etc.). While the main drive is handling a current step, the auxiliary drive can be preparing equipment for a subsequent step.

Once an offshore drilling rig is moored on the drill site, the general flow of operations is as follows: the drilling starts with the largest size drill bit to be used for this site, e.g. 36 inches. A string of drill pipe is built and extended to the sea floor. The well is drilled to a given depth with this size bit, then the drill string is pulled out and casing is placed in the wellbore and cemented in place. Then the next smaller size of drill bit is installed on the workstring, and the next section of wellbore is drilled, then cased, and so on. As soon as sufficient pipe has been cemented in the hole to provide a competent structural foundation for the seabed pressure containment equipment, a blowout protector (BOP) is run on marine riser pipe and placed at the sea bed on the well head and remains in place until all drilling and casing are complete. Marine riser normally consists of large diameter pipe sections each between 50 ft and 100 feet long and connected together with high strength bolts, dogs or other mechanism. Each section supports additional smaller diameter high-pressure pipes and electrical control cable and the assembly and disassembly of the marine riser string in deep water is a time consuming operation. Once in place, the riser provides an enclosed space through which the drill pipe and bit will be lowered to the borehole, and through which the drilling mud will be returned from the borehole to the drill rig. Once the well is drilled and cased, and production tubing is installed, the BOP must be removed from the wellhead and replaced with a production structure known as a Xmas tree. It is desirable to remove the BOP and install a Xmas tree in as short a time as possible, as the wellhead is not protected while the switch-over is happening. In installations where there is only one hoisting path, the BOP and marine riser must be pulled up and disassembled before the Xmas tree can be lowered on its string of tubing, requiring a great deal of time for the entire operation. In an installation having two hoisting paths, the Xmas tree is run on one load path while the BOP and riser is suspended on the other. The BOP and riser can be disassembled after use, or it may be desirable to immediately re-use them at an adjacent well site without disassembling them. Because the two load paths are in the same derrick and therefore close together there is a danger that the Xmas tree and the BOP will at some point collide and damage either one or both. It would be desirable to have a method of obtaining more separation between these two pieces of equipment during handling, without affecting the savings in time gained by the two load paths.

SUMMARY OF THE INVENTION

This invention provides a means to suspend the BOP and riser string in such a manner that it can then be moved to the other end of the moon pool from the load path on which the Xmas tree is run. The horizontal separation provided by this maneuver is sufficient to reduce the risk of collision between BOP and Xmas tree to an acceptable level.

To suspend and move the string, a cart is provided which runs on rails located on both sides of the moonpool area. These rails are also used by the BOP elevator, which supports and stabilizes the blowout protector while it is being moved from storage to its underwater site. The cart is of heavy construction, with a rectangular base and wheels at each corner. A funnel-shaped opening runs through the cart, narrowing from top to bottom, while a roughly C-shaped opening in the front of the cart is wide enough to allow a marine riser or other tubular to be admitted within the opening. The cart can be moved on rails to the load path that is handling the BOP, so that the riser and BOP can be suspended from the cart. The cart, with the riser and BOP hanging from it, can then be moved to one side of the moonpool, where it will remain until it is required again by the operation. In one embodiment of the invention, the blowout protector (BOP) is disconnected from the well head, raised some distance above the seabed (e.g., 50 feet), and hung from the cart. After the cart is moved to the side of the rig opposite the hoist handling the Xmas tree, the Xmas tree assembly can be installed, without the need to completely pull the BOP and riser out of the water. Once the Xmas tree assembly is in place, the BOP can be pulled up or moved to an adjacent well head. This increases the safety of this exchange without slowing the path of critical operations.

BRIEF DESCRIPTION OF THE DRAWINGS

Other objects and advantages of the present invention will become apparent from the following detailed description of a preferred embodiment thereof, taken in conjunction with the accompanying drawings, wherein.

DETAILED DESCRIPTION OF THE DRAWINGS

Figure 1A:
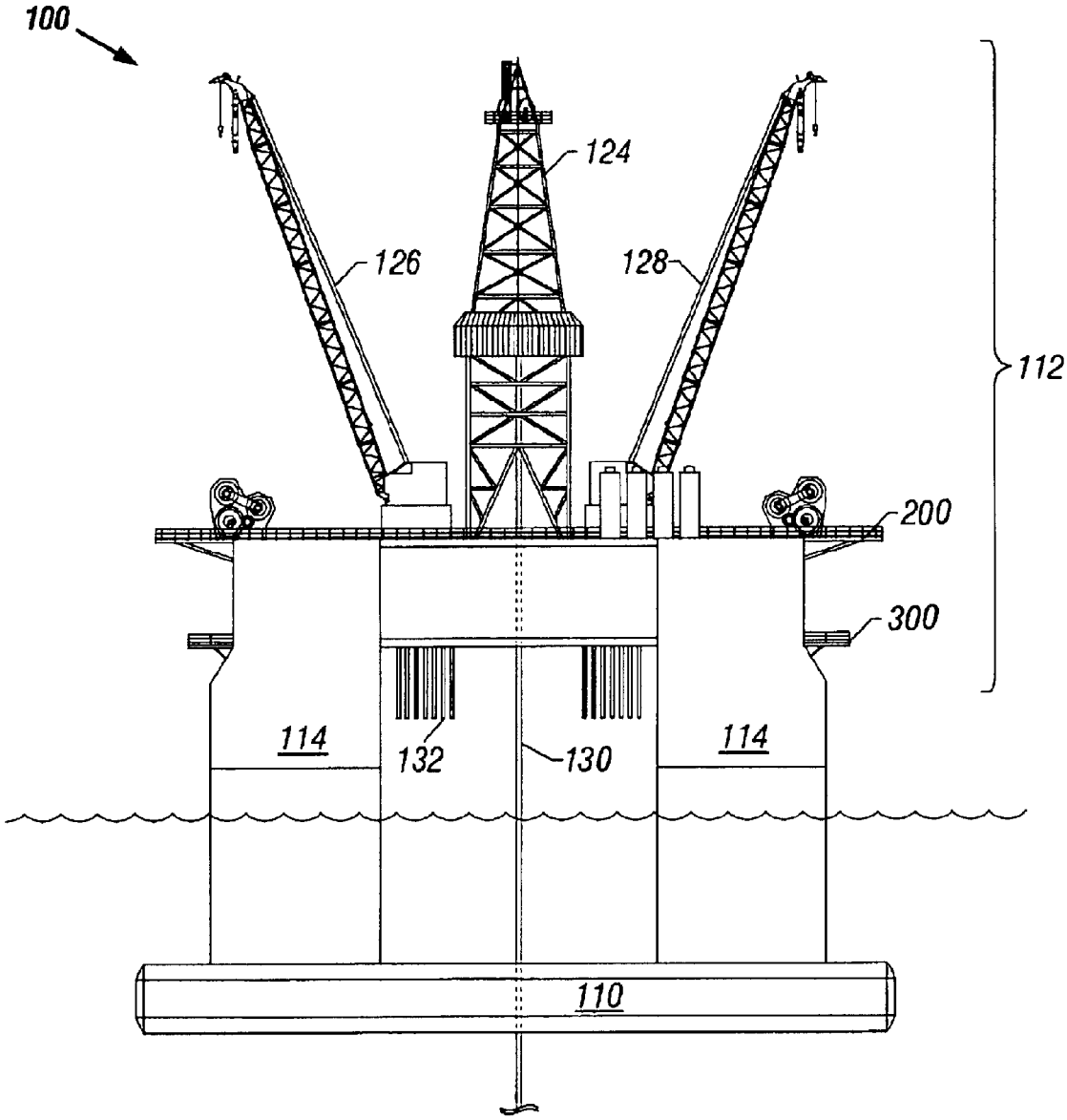
FIGS. 1A and 1B are views of a semi-submersible drill rig from the side and front.
Figure 1B:
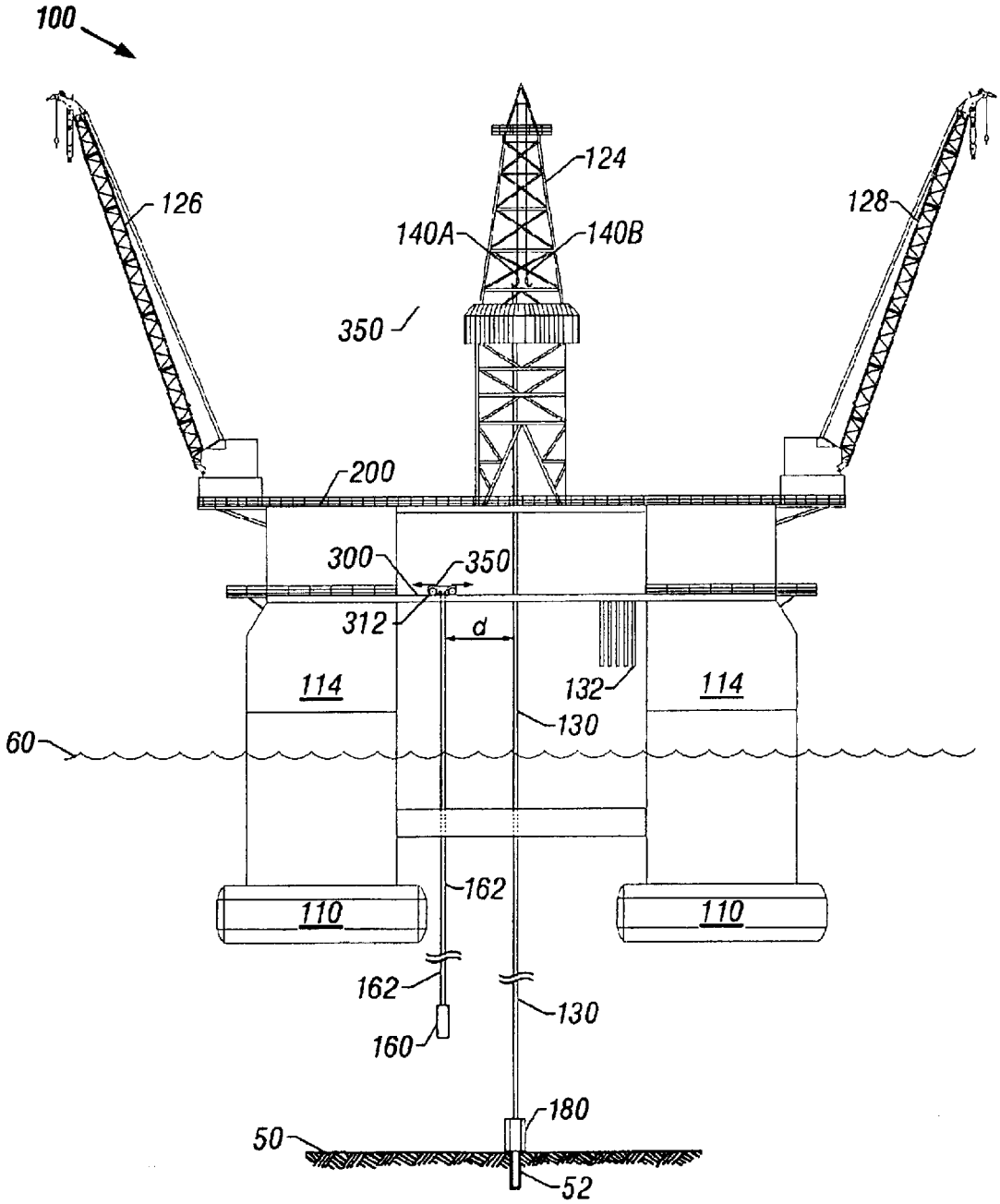

FIGS. 1A and 1B show side and front views of a semi-submersible drilling rig on which the disclosed invention can be utilized, although these views are greatly simplified for ease of understanding. With reference first to FIG. 1A, the semi-submersible rig 100 has flotation elements 110, which provide buoyancy, and a working area 112, joined together by stability columns 114. The working area 112 is divided into different decks, but only two of these are of importance in this discussion and are shown. These are the drilling deck 120 and the main deck 122. In this view, the drilling derrick 124 rises from the drilling deck 120. Seen hanging adjacent to the primary load path 130 below the main deck 122 are riser sections 132. Riser sections 132 can be stored horizontally in pipe racks or vertically; when stored vertically, as seen here the riser sections 132 extend vertically through the working area, with their lower portions seen below the decks.

FIG. 1B shows a view of the semi submersible from the front of the rig. Large cranes 126 and 128 occupy sections of the drilling deck 120. Drilling derrick 124 is seen to have two hoist assemblies 140 for handling the various tubular structures (drill pipe, casing, risers, etc.) which are used in drilling and preparing a well for production. One hoist assembly, 140A, is designated the primary assembly, while the other, 140B, is the secondary assembly. Each of these hoist assemblies is associated with a system for rotating the drill pipe, either a top drive or a rotary table (not specifically shown). Having two hoists and two rotary assemblies allows a string of tubulars to be put together by the secondary hoist assembly 140B at the same time the primary hoist assembly 140A is handling other steps in the drilling process. This type of work sharing is further explained in U.S. Pat. No. 6,047,781, which is hereby incorporated by reference. The primary and secondary hoist assemblies are located some distance apart, e.g. 30 feet, so that work on one does not interfere with work on the other. It is worth noting that at the ocean floor 50, which can currently be as much as a mile and a half below the water surface 60, the end of a work string will be guided into proper position by Remote Operated Vehicles (ROVs). In the water depths contemplated by this invention drill pipe is very flexible and a mile-long string of it will easily bridge the 30 or so foot separation between the two rotary assemblies without having to reposition the rig 100. As a result either the primary or secondary rotary assembly can be active in the borehole 52 at any particular moment. Cart 350 is seen on the main deck 122 of the rig 100, where it can traverse most of the width of the deck 122 on its rails.

Figure 2:
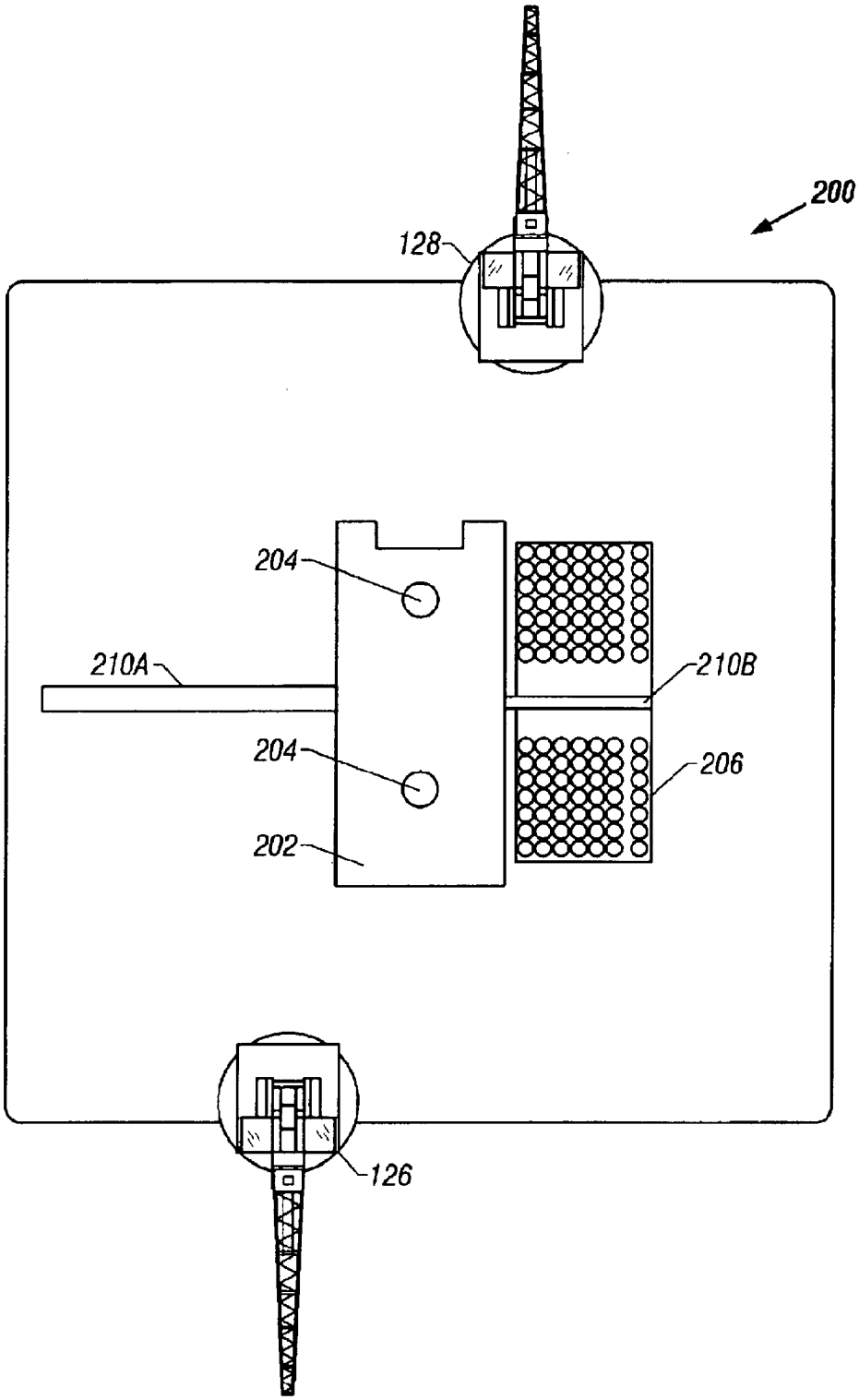
FIG. 2 is a layout of the drill floor of the semi-submersible drill rig.

Turning now to FIG. 2, a simplified layout of the drilling deck 120 is shown. The derrick floor 202 is elevated above the rest of the drilling deck 120. Rotary tables 204 are positioned in the drill floor below the primary and secondary hoisting paths. On the drill floor, drill pipe and the drill bit is made up and run through the water column to the sea bed where it is rotated by either the rotary table or a rotating mechanism (top drive) suspended in the derrick. Later, casing tubulars are assembled in one of the hoisting paths and run into the hole 52. Ramps 210A and 210B feed pipes to the primary and secondary hoisting paths respectively. In this embodiment risers 206 are stored vertically here and extend through the deck to the level below although the riser can also be stored horizontally.

Figure 3:
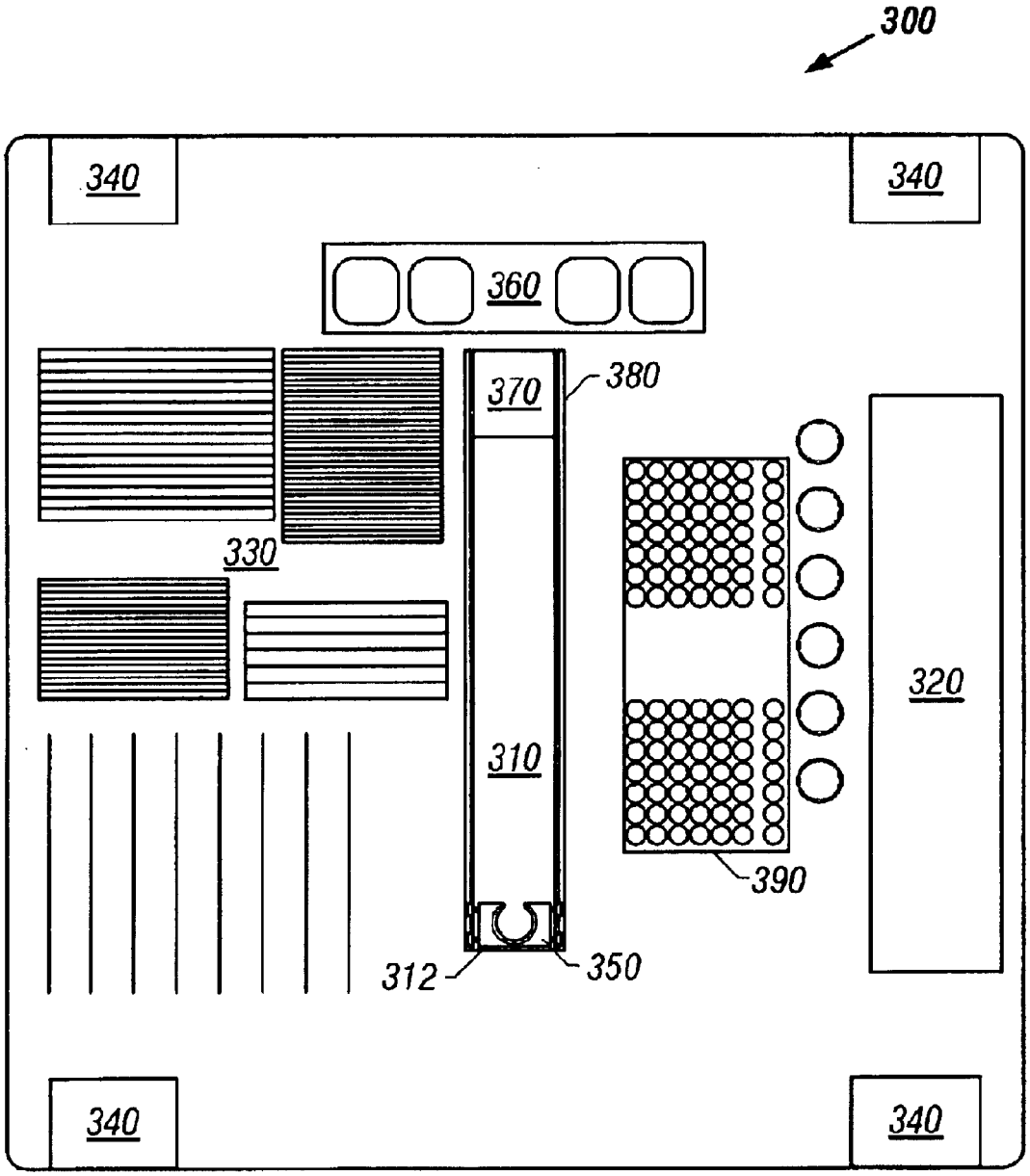
FIG. 3 is a layout of the main level of the drill rig, showing an embodiment of the present invention.

FIG. 3 shows a schematic of the layout of the main deck 122 level. Central to this level is the moonpool 310, an open area through which the tubulars are extended from the drilling floor to the seabed 50. The cranes 126, 128 have their bases on opposite sides of the main deck 122, with booms of sufficient length to reach most areas. Other features seen on this level include portions of crew living quarters 320, mooring assemblies 340, riser storage area 390, pipe storage areas 330, and storage areas 360 for the blow-out protector (BOP) and Xmas tree assemblies. Rails 380 run on either side of the moonpool 310. These rails 380 are used to carry the BOP elevator 370, which is used to transport the BOP from its storage position to a position under the primary load path 130 where it can be connected to the marine riser. The rails 380 are also used to carry the innovative support cart 350.

Figure 4:
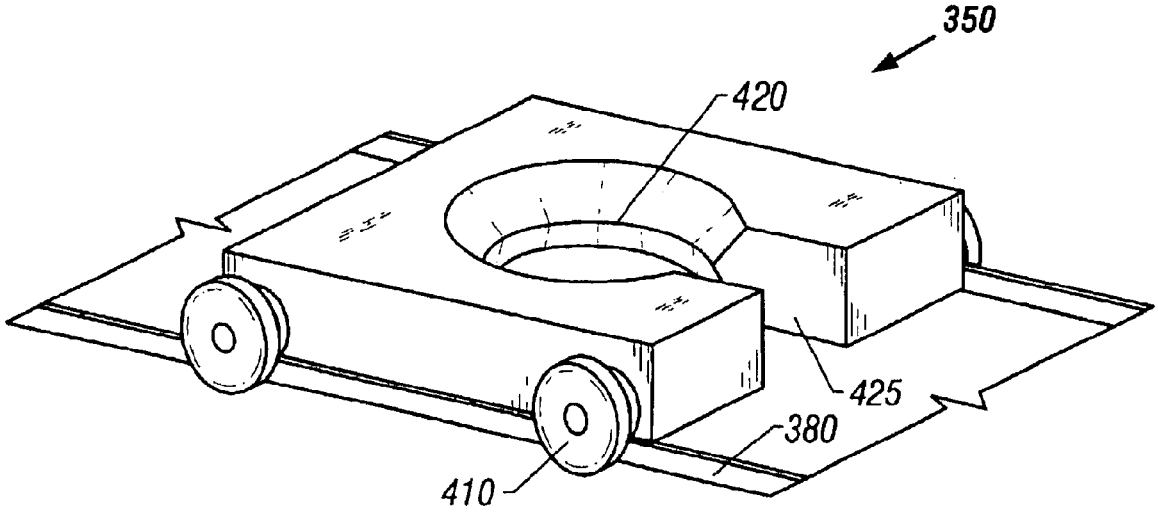
FIG. 4 is a perspective of one embodiment of the cart of the present invention, which is used to hold a portion of riser or other tubular.

FIG. 4 shows a preferred embodiment of the support cart 350. In this preferred embodiment, the cart is rectangular in shape, with two wheels 410 on each of the two shorter sides. The width of the cart is such that the cart straddles the moonpool, with its wheels 410 riding on the rails 380 on either side of the moonpool. In the center of the cart, a truncated funnel-shaped hole 420 extends through the cart. One side of the cart features a C-shaped slot 425, sized to allow the insertion and removal of a section of marine riser.

As shown in the Figures, the support cart 350 can be used near the end of the development of the well, when it is time for the BOP 160 to be pulled and replaced by a Xmas tree assembly 180. Rather than pulling the BOP 160 completely out of the water or leaving it in relatively close proximity to the Xmas tree assembly 180, the BOP 180, attached to its string of marine riser pipe 162, is pulled out of the hole 52 a short distance (e.g., 50 feet), so that it can clear the seabed 50 as it is moved. Then the entire assembly of marine riser 162, with BOP 160 at the end, is hung on the support cart 350, which receives the entire weight of the string. In the presently preferred embodiment, cart 350 has a static capacity of 700 metric tons. The cart 350 will then be moved to a position at the end 312 of the moonpool, distant d from the Xmas tree assembly 180 that is being installed. This lateral movement reduces the risk of a collision between the BOP 160 and the Xmas tree 180 to an acceptable level. The riser 162 and BOP 160 will remain at this location until the operation requires the BOP 160 to be installed on an adjacent well head or for the BOP 160 to be retrieved to the rig 100.

Thus, the innovative cart increases safety on the rig, decreases the likelihood of damage to expensive equipment machinery, and allows time consuming operations such as retrieving the BOP and riser to be performed offline.

We claim:

1. A device for providing lateral separation between two adjacent strings of tubular assemblies suspended from an offshore drilling rig having a working area suspended above the surface of a body of water, comprising:

a heavy-duty cart from which a first tubular assembly can be suspended through a moonpool area, said first tubular assembly extending through said moonpool into said body of water; and a rail assembly capable of carrying said heavy-duty cart; ps wherein said cart may translate along said rail assembly to move said first tubular assembly away from a primary load path thereby altering lateral separation between said first tubular assembly and said primary load path so that a second tubular assembly may be advanced into the body of water along said primary load path.

2. The device of claim 1, wherein said cart has an opening through one side through which marine riser pipe can be inserted.

3. The cart of claim 1, wherein said cart can carry a load of greater than 100 metric tons.

4. The cart of claim 1, wherein said cart comprising a substantially rectangular base having an opening therethrough and wherein a side of said cart contains a passageway through which marine riser pipe can be inserted into said opening.

5. The device of claim 1, wherein said first tubular assembly comprises a blow-out protector (BOP) attached to a string of marine riser pipe.

6. An offshore drilling structure comprising:

a working area suspended above the surface of a body of water, said working area comprising a first deck having means for conducting drilling activities along a primary load path and a second deck positioned below said first deck, said second deck having an open moonpool area through which tubular assemblies may be extended from the first deck into said body of water;

a pair of rails positioned on opposing sides of said moonpool area; and a cart, moveable on said rails, and operative for suspending a first tubular assembly over said moonpool area, said first tubular assembly comprising a blow-out protector (BOP) attached to a string of marine riser pipe;

wherein movement of said cart along said rails alters the lateral separation between said first tubular assembly and said primary load path allowing a second tubular assembly to be advanced along said primary load path.

7. The offshore drilling structure of claim 6, wherein said drilling structure is a semi-submersible drill rig.

8. The offshore drilling structure of claim 6, wherein said cart comprises a substantially rectangular base having an opening therethrough and wherein a side of said cart contains a passageway through which a length of pipe can be inserted into said opening.

9. The offshore drilling structure of claim 8, wherein said opening is substantially funnel-shaped.

10. The offshore drilling structure of claim 6, wherein said cart can carry a load greater than 100 mega-tons.

11. The offshore drilling structure of claim 6, wherein said first deck further includes more than one drilling station operative for conducting drilling activities along said primary load path, wherein a first drilling station comprises a first hoist, which is associated with a first load path and a first rotary table, and a second drilling station comprises a second hoist, which is associated with a second load path and a second rotary table.

12. A method for conducting drilling operations from an offshore structure having a working area suspended above the surface of a body of water, said method comprising the steps of;

advancing a first tubular assembly into said body of water from a first deck of said working area along a primary load path, wherein said first tubular assembly comprises a blow-out protector (BOP) attached to a string of marine riser pipe, and wherein said primary load path extends through an open moonpool area formed in a second deck of said working area to the seabed;

suspending a portion of said first tubular assembly from a cart that straddles said moonpool area, said cart including means for translating along a rail assembly attached to said second deck;

moving said portion of said first tubular assembly along said rail assembly to laterally separate said first tubular assembly from a second tubular assembly extending from said first deck of said working area to the seabed along said primary load path.

13. The method of claim 12, wherein said first tubular assembly comprises a blow-out protector (BOP) attached to a string of marine riser pipe.

14. The method of claim 12, wherein said second tubular assembly comprises a Xmas tree assembly.

15. The method of claim 12, wherein said offshore structure is a semi-submersible rig.

* * * * *

UNITED STATES PATENT AND TRADEMARK OFFICE

CERTIFICATE OF CORRECTION

PATENT NO. : 6,766,860 B2
DATED : July 27, 2004
INVENTOR(S) : William G. Archibald et al.

It is certified that error appears in the above-identified patent and that said Letters Patent is hereby corrected as shown below:

Column 4,
Line 39, after "distant", "d" should be bold and in italic;
Line 61, before "wherein said cart", please delete "ps".

Signed and Sealed this

Twelfth Day of April, 2005

JON W. DUDAS
*Director of the United States Patent and Trademark Office*